US008256522B2

(12) United States Patent
Veit et al.

(10) Patent No.: US 8,256,522 B2
(45) Date of Patent: Sep. 4, 2012

(54) SAND CONTROL SCREEN ASSEMBLY HAVING REMOTELY DISABLED REVERSE FLOW CONTROL CAPABILITY

(75) Inventors: Jan Veit, Plano, TX (US); Jean-Marc Lopez, Plano, TX (US); Floyd Randolph Simonds, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 392 days.

(21) Appl. No.: 12/761,285

(22) Filed: Apr. 15, 2010

(65) Prior Publication Data

US 2011/0253391 A1 Oct. 20, 2011

(51) Int. Cl.
*E21B 43/12* (2006.01)
*E21B 34/06* (2006.01)

(52) U.S. Cl. ..... 166/386; 166/373; 166/227; 166/236

(58) Field of Classification Search ..... 166/386, 166/373, 227, 233, 236
See application file for complete search history.

(56) References Cited

U.S. PATENT DOCUMENTS

| | | | |
|---|---|---|---|
| 148,387 | A | 3/1874 | Squires |
| 1,536,348 | A | 5/1925 | Mack |
| 2,517,841 | A | 8/1950 | Chenault |
| 2,602,516 | A | 7/1952 | Gray |
| 5,320,178 | A | 6/1994 | Cornette |
| 5,337,808 | A | 8/1994 | Graham |
| 5,435,393 | A | 7/1995 | Brekke et al. |
| 5,803,179 | A | 9/1998 | Echols et al. |
| 5,812,331 | A | 9/1998 | Lopez et al. |
| 5,896,928 | A | 4/1999 | Coon |
| 6,112,815 | A | 9/2000 | Boe et al. |
| 6,112,817 | A | 9/2000 | Voll et al. |
| 6,343,651 | B1 | 2/2002 | Bixenman |
| 6,371,210 | B1 | 4/2002 | Bode et al. |
| 6,470,749 | B1 | 10/2002 | Han et al. |
| 6,622,794 | B2 | 9/2003 | Zisk, Jr. |
| 6,644,412 | B2 | 11/2003 | Bode et al. |
| 6,719,051 | B2 | 4/2004 | Hailey, Jr. et al. |
| 6,786,285 | B2 | 9/2004 | Johnson et al. |

(Continued)

FOREIGN PATENT DOCUMENTS

| | | |
|---|---|---|
| GB | 2421746 | 7/2006 |

(Continued)

OTHER PUBLICATIONS

Martin P. Coronado, Next Generation Sand Screen Enables Drill-in Sandface Completions, Offshore (Dec. 2009), pp. 54-56.

*Primary Examiner* — Giovanna Wright
(74) *Attorney, Agent, or Firm* — Lawrence R. Youst

(57) ABSTRACT

A flow control screen having a fluid flow path between a perforated section of a base pipe and a filter medium positioned around a blank pipe section of the base pipe. A valve assembly, including a piston body and a valve plug, is disposed within the fluid flow path. The piston body has an internal seat and a collet assembly that is radially outwardly constrained in a first operating position of the piston body to retain the valve plug therein and radially outwardly unconstrained in a second operating position of the piston body. Reverse flow is initially prevented as an internal differential pressure seats the valve plug on the internal seat and causes the piston body to shift to the second operating position upon reaching a predetermined threshold. Thereafter, an external differential pressure causes the valve plug to be expelled through the collet assembly, thereby no longer preventing reverse flow.

20 Claims, 10 Drawing Sheets

U.S. PATENT DOCUMENTS

| | | | |
|---|---|---|---|
| 6,857,476 | B2 | 2/2005 | Richards |
| 6,883,613 | B2 | 4/2005 | Bode et al. |
| 6,886,634 | B2 | 5/2005 | Richards |
| 6,899,176 | B2 | 5/2005 | Hailey, Jr. et al. |
| 6,978,840 | B2 | 12/2005 | Henderson |
| 7,055,598 | B2 | 6/2006 | Ross et al. |
| 7,096,945 | B2 | 8/2006 | Richards et al. |
| 7,100,686 | B2 | 9/2006 | Wittrisch |
| 7,152,688 | B2 | 12/2006 | Richards |
| 7,185,706 | B2 | 3/2007 | Freyer |
| 7,191,833 | B2 | 3/2007 | Richards |
| 7,204,316 | B2 | 4/2007 | Dusterhoft et al. |
| 7,252,153 | B2 | 8/2007 | Hejl et al. |
| 7,413,022 | B2 | 8/2008 | Broome et al. |
| 7,426,962 | B2 | 9/2008 | Moen et al. |
| 7,451,815 | B2 | 11/2008 | Hailey et al. |
| 7,469,743 | B2 | 12/2008 | Richards |
| 7,537,056 | B2 | 5/2009 | MacDougall |
| 7,708,068 | B2 | 5/2010 | Hailey, Jr. |
| 7,775,283 | B2 | 8/2010 | Coronado et al. |
| 7,775,284 | B2 | 8/2010 | Richards et al. |
| 7,789,145 | B2 | 9/2010 | Patel |
| 7,802,621 | B2 | 9/2010 | Richards et al. |
| 7,841,398 | B2 | 11/2010 | Tibbles et al. |
| 7,891,420 | B2 | 2/2011 | Dale et al. |
| 7,918,275 | B2 | 4/2011 | Clem |
| 2006/0186601 | A1 | 8/2006 | Lopez |
| 2007/0012444 | A1 | 1/2007 | Horgan et al. |
| 2008/0035330 | A1 | 2/2008 | Richards |
| 2008/0041580 | A1 | 2/2008 | Freyer et al. |
| 2008/0041581 | A1 | 2/2008 | Richards |
| 2008/0041588 | A1 | 2/2008 | Richards et al. |
| 2008/0283238 | A1 | 11/2008 | Richards et al. |
| 2009/0000787 | A1 | 1/2009 | Hill et al. |
| 2009/0065199 | A1 | 3/2009 | Patel et al. |
| 2009/0133882 | A1 | 5/2009 | Delaloye et al. |
| 2009/0151925 | A1 | 6/2009 | Richards et al. |
| 2009/0277650 | A1 | 11/2009 | Casciaro et al. |
| 2011/0198097 | A1 | 8/2011 | Moen |

FOREIGN PATENT DOCUMENTS

| | | |
|---|---|---|
| GB | 2455001 | 7/2009 |
| WO | 02075110 | 9/2002 |
| WO | 2004018837 | 3/2004 |
| WO | 2009048822 | 4/2009 |
| WO | 2009048823 | 4/2009 |
| WO | 2009065793 | 5/2009 |
| WO | 2009065890 | 5/2009 |
| WO | 2009066097 | 5/2009 |
| WO | 2009067021 | 5/2009 |

SAND CONTROL SCREEN ASSEMBLY HAVING REMOTELY DISABLED REVERSE FLOW CONTROL CAPABILITY

TECHNICAL FIELD OF THE INVENTION

This invention relates, in general, to equipment utilized in conjunction with operations performed in subterranean wells and, in particular, to a flow control screen assembly that is operable to control the inflow of formation fluids and selectively operable to prevent reverse flow of fluids into the formation.

BACKGROUND OF THE INVENTION

Without limiting the scope of the present invention, its background will be described with reference to producing fluid from a hydrocarbon bearing subterranean formation, as an example.

During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screens positioned proximate the desired production intervals. In other completions, to control the flow rate of production fluids into the production tubing, it is common practice to install one or more flow control devices within the tubing string.

Attempts have been made to utilize fluid flow control devices within completions requiring sand control. For example, in certain sand control screens, after production fluids flows through the filter medium, the fluids are directed into a flow control section. The flow control section may include one or more flow restrictors such as flow tubes, nozzles, labyrinths or the like. Typically, the production rate through these flow control screens is fixed prior to installation by individually adjusting the flow restrictors of the flow control screens.

It has been found, however, that the during the completion process, it may be desirable to pressure up the completion string to operate or set certain tools, such as packers. Current flow control screens require the running of a separate work string into the completion string to achieve this result or require that one or more permanent check valves be incorporated into each of the flow control screens. In addition, it has been found, that it may desirable to allow reverse flow from the completion string into the formation in certain completions requiring fluid flow control, sand control and tools setting capabilities.

Accordingly, a need has arisen for a flow control screen that is operable to control the inflow of formation fluids in a completion requiring sand control. A need has also arisen for such a flow control screen that is operable to be pressured up during the completion process. Further, a need has arisen for such a flow control screen that is operable to selectively allow reverse flow from the completion string into the formation.

SUMMARY OF THE INVENTION

The present invention disclosed herein comprises a flow control screen for controlling the inflow of formation fluids in completions requiring sand control. In addition, the flow control screen of the present invention is operable to be pressured up during the completion process. Further, the flow control screen of the present invention is operable to selectively allow reverse flow from the completion string into the formation.

In one aspect, the present invention is directed to a flow control screen having a fluid flow path between a perforated section of a base pipe and a filter medium positioned around a blank pipe section of the base pipe. The flow control screen comprises at least one valve assembly disposed within the fluid flow path. The valve assembly includes a piston body and a valve plug. The piston body has an internal seat and a collet assembly that is radially outwardly constrained in a first operating position of the piston body to retain the valve plug therein and radially outwardly unconstrained in a second operating position of the piston body. Reverse flow is initially prevented as an internal differential pressure seats the valve plug on the internal seat and causes the piston body to shift from the first operating position to the second operating position upon reaching a predetermined internal differential pressure. Thereafter, an external differential pressure causes the valve plug to be expelled through the collet assembly, thereby no longer preventing reverse flow.

In one embodiment, the valve assembly further includes a retainer sleeve that radially outwardly constrains the collet assembly in the first operating position of the piston body. In this embodiment, the piston assembly may be slidably positioned within an axial opening of a housing member of the flow control screen. Also, in this embodiment, the piston assembly and the housing member may be initially secured together with a retainer pin that prevents movement of the piston body from the first operating position to the second operating position until the predetermined internal differential pressure acts on the valve plug.

In another embodiment, the valve assembly further includes a cylinder assembly that radially outwardly constrains the collet assembly in the first operating position of the piston body but does not radially outwardly constrain the collet assembly in the second operating position of the piston body. In this embodiment, the piston assembly may be slidably positioned within the cylinder assembly. Also, in this embodiment, the piston assembly and the cylinder assembly may be initially secured together with a retainer pin that prevents movement of the piston body from the first operating position to the second operating position until the predetermined internal differential pressure acts on the valve plug.

In one embodiment, the valve plug may be in the form of a spherical blocking member. In another embodiment, the collet assembly may include a plurality of collet fingers having radially inwardly projecting lips. In a further embodiment, the collet assembly may include a plurality of collet fingers having radially outwardly projecting lips. In yet another embodiment, the flow control screen may include a fluid flow control section in the fluid flow path that causes a pressure drop in fluids traveling therethrough. In an additional embodiment, the flow control screen may include at least one reentry barrier in the fluid flow path operable to prevent reentry of the valve plug into the piston body.

In another aspect, the present invention is directed to a flow control screen having a fluid flow path between a perforated section of a base pipe and a filter medium positioned around a blank pipe section of the base pipe. The flow control screen comprises a plurality of circumferentially distributed valve assemblies disposed within the fluid flow path. Each valve assembly includes a piston body and a valve plug. Each piston body has an internal seat and a collet assembly that is radially outwardly constrained in a first operating position of the piston body to retain the valve plug therein and radially outwardly unconstrained in a second operating position of the piston body. Reverse flow is initially prevented as an internal differential pressure seats the valve plugs on the internal seats and causes the piston bodies to shift from the first operating position to the second operating position upon reaching a predetermined internal differential pressure. Thereafter, an external differential pressure causes the valve plugs to be expelled through the collet assemblies, thereby no longer preventing reverse flow.

In a further aspect, the present invention is directed to a method for operating a flow control screen. The method includes disposing at least one valve assembly within a fluid flow path between a perforated section of a base pipe and a filter medium positioned around a blank pipe section of the base pipe; retaining a valve plug within a piston body of the valve assembly by radially outwardly constraining a collet assembly in a first operating position of the piston body; applying an internal differential pressure to seat the valve plug on an internal seat of the piston body to prevent reverse flow; applying a predetermined internal differential pressure on the valve plugs to shift the piston body from the first operating position to a second operating position while continuing to prevent reverse flow; and applying an external differential pressure to expel the valve plug through the collet assembly, thereby no longer preventing reverse flow.

The method may also include using a retainer sleeve to radially outwardly constrain the collet assembly in a first operating position of the piston body, using a cylinder assembly to radially outwardly constrain the collet assembly in a first operating position of the piston body, shearing a retainer pin responsive to application of the predetermined internal differential pressure to shift the piston body from the first operating position to the second operating position or preventing reentry of the valve plug into the piston body with at least one reentry barrier disposing within the fluid flow path between the perforated section of the base pipe and the at least one valve assembly.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
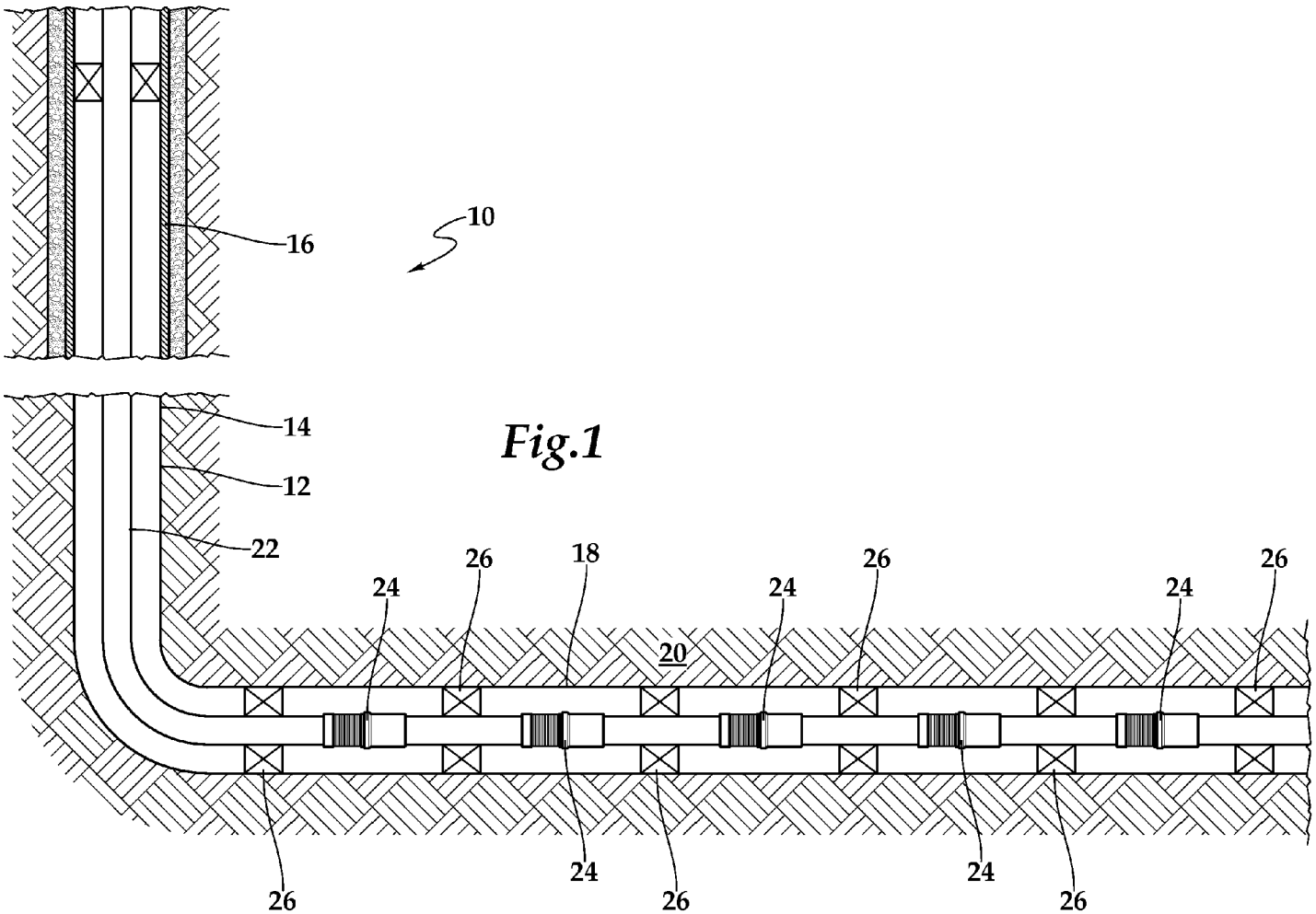
FIG. 1 is a schematic illustration of a well system operating a plurality of flow control screens according to an embodiment of the present invention.

Referring initially to FIG. 1, therein is depicted a well system including a plurality of flow control screens embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface. At its lower end, tubing string 22 is coupled to a completions string that has been installed in wellbore 12 and divides the completion interval into various production intervals adjacent to formation 20. The completion string includes a plurality of flow control screens 24, each of which is positioned between a pair of packers 26 that provides a fluid seal between the completion string 22 and wellbore 12, thereby defining the production intervals.

Flow control screens 24 serve the primary functions of filtering particulate matter out of the production fluid stream and controlling the flow rate of the production fluid stream. In addition, as discussed in greater detail below, flow control screens 24 are operable to be pressured up during installation of the completion string. For example, when the completion string is positioned in the desired location in wellbore 12, internal pressure may be used to set packers 26 to divide the completion interval into the desired number of production intervals. During this setting process, flow control screens 24 are in their running configuration in which they are operable to hold pressure for repeated cycles as long as the pressure remains below a predetermined threshold pressure. Once all pressure operated completion components are set or during the setting of the final pressure operated completion component, the internal pressure may be raised above the predetermined threshold pressure to operate flow control screens 24 into their sheared configuration. In this configuration, flow control screens continue to hold pressure, however, when the internal pressure is released and the differential pressure across flow control screens 24 is positive between the outside and inside of flow control screens 24, flow control screens 24 are operated to their production configuration.

Even though FIG. 1 depicts the flow control screens of the present invention in an open hole environment, it should be understood by those skilled in the art that the flow control screens of the present invention are equally well suited for use in cased wells. Also, even though FIG. 1 depicts one flow control screen in each production interval, it should be understood by those skilled in the art that any number of flow control screens of the present invention may be deployed within a production interval without departing from the principles of the present invention. In addition, even though FIG. 1 depicts the flow control screens of the present invention in a horizontal section of the wellbore, it should be understood by those skilled in the art that the flow control screens of the present invention are equally well suited for use in well having other directional configurations including vertical wells, deviated wellbores, slanted wells, multilateral well and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
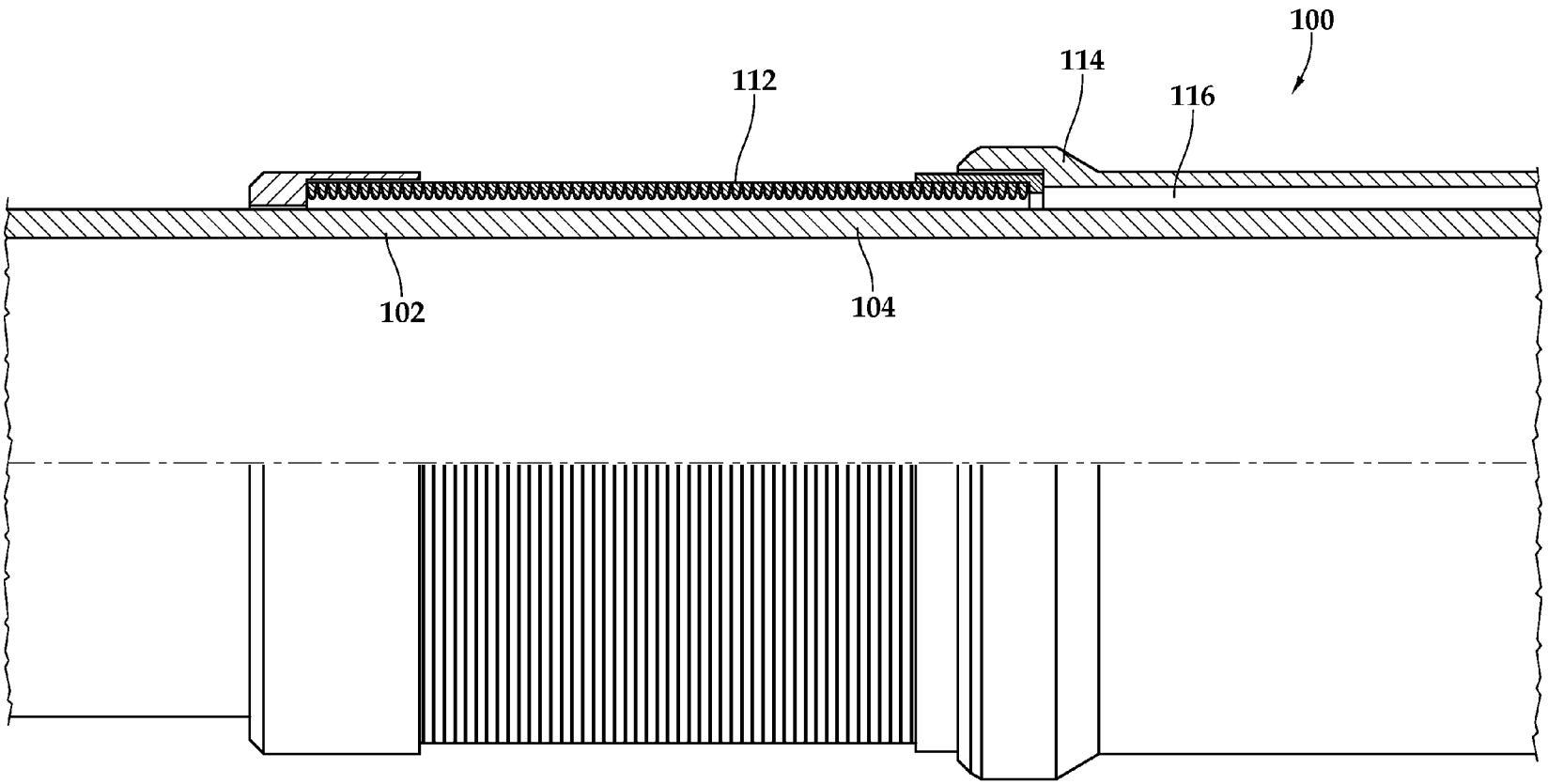
FIGS. 2A-2C are quarter sectional views of successive axial sections of a flow control screen according to an embodiment of the present invention.
Figure 2B:
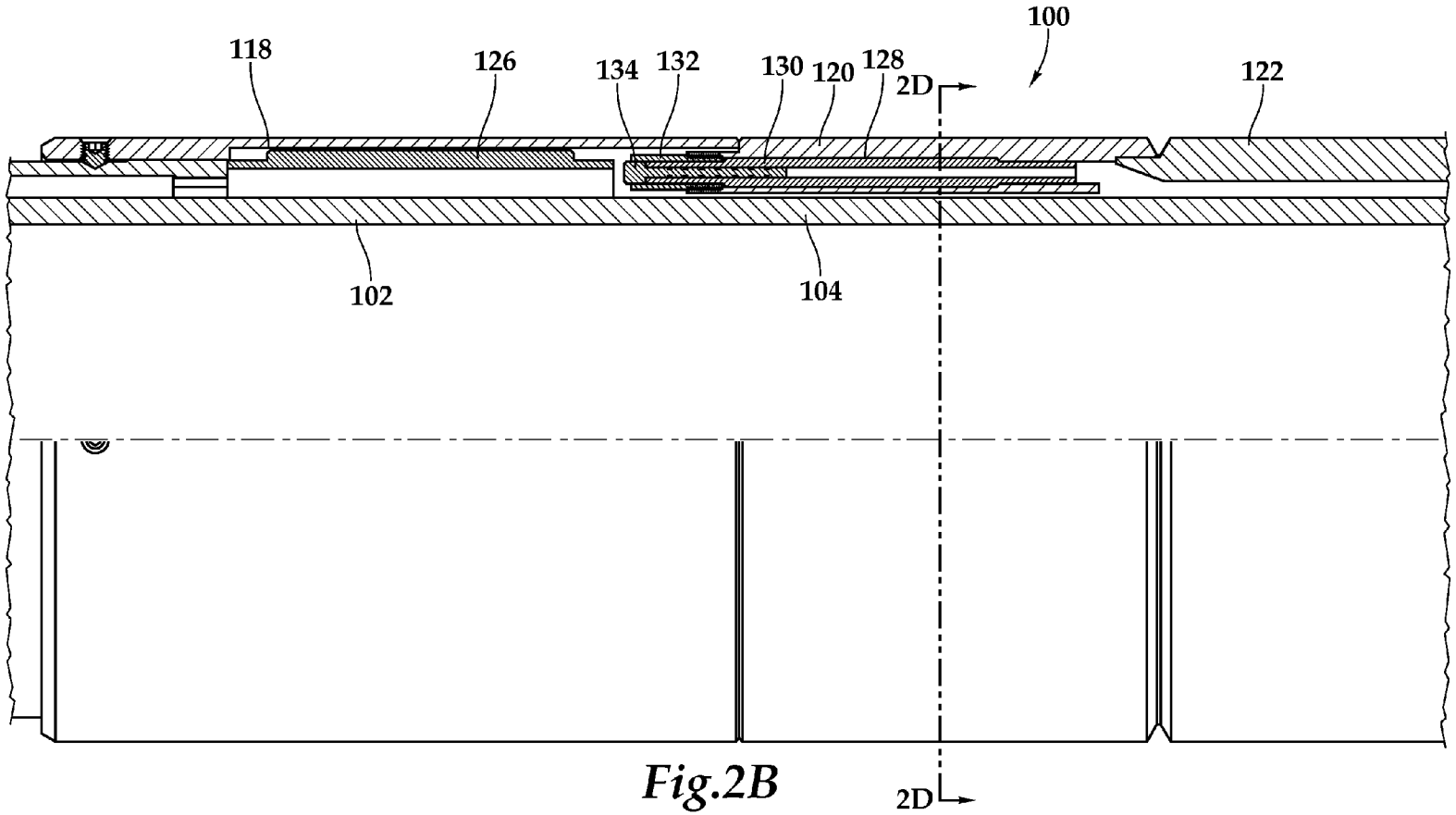
Figure 2C:
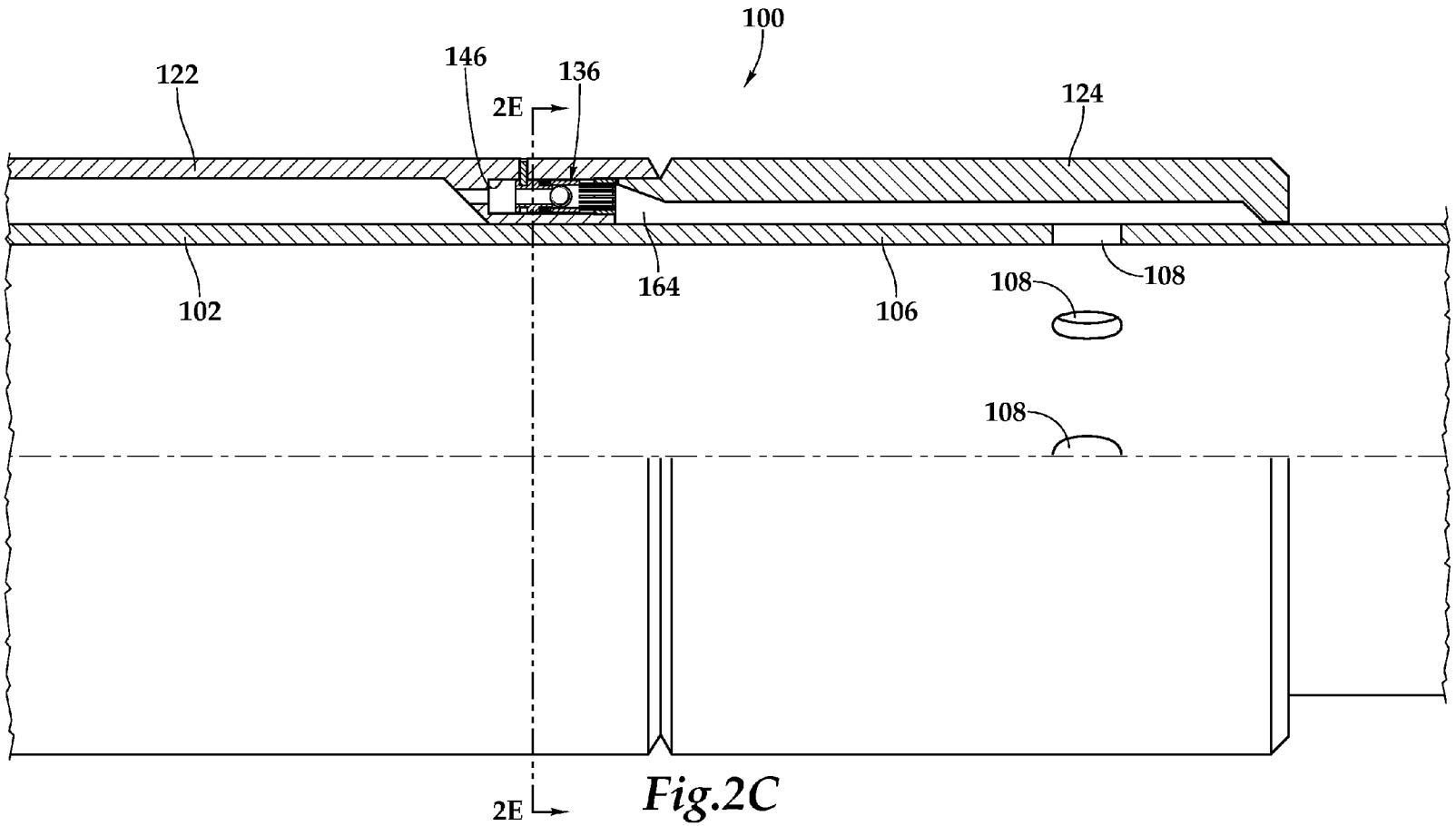

Referring next to FIGS. 2A-2C, therein is depicted successive axial sections of a flow control screen according to the present invention that is representatively illustrated and generally designated 100. Flow control screen 100 may be suitably coupled to other similar flow control screens, production packers, locating nipples, production tubulars or other downhole tools to form a completions string as described above. Flow control screen 100 includes a base pipe 102 that has a blank pipe section 104 and a perforated section 106 including a plurality of production ports 108. Positioned around an uphole portion of blank pipe section 104 is a screen element or filter medium 112, such as a wire wrap screen, a woven wire mesh screen, a prepacked screen or the like, designed to allow fluids to flow therethrough but prevent particulate matter of a predetermined size from flowing therethrough. Positioned downhole of filter medium 112 is a screen interface housing 114 that forms an annulus 116 with base pipe 102. Securably connected to the downhole end of screen interface housing 114 is a sleeve housing 118. At its downhole end, sleeve housing 118 is securably connected to a flow tube housing 120 which is securably connected to the uphole end of an intermediate housing 122. In addition, flow tube housing 120 is preferably securably connected or sealably coupled to base pipe 102 to prevent fluid flow therebetween. Toward its downhole end, intermediate housing 122 is securably connected to a production port housing 124 which is preferably welded to base pipe 102 at its downhole end. The various connections of the housing sections may be made in any suitable fashion including welding, threading and the like as well as through the use of fasteners such as pins, set screws and the like. Together, the housing sections create a generally annular fluid flow path between filter medium 112 and perforated section 106 of base pipe 102.

Figure 2D:
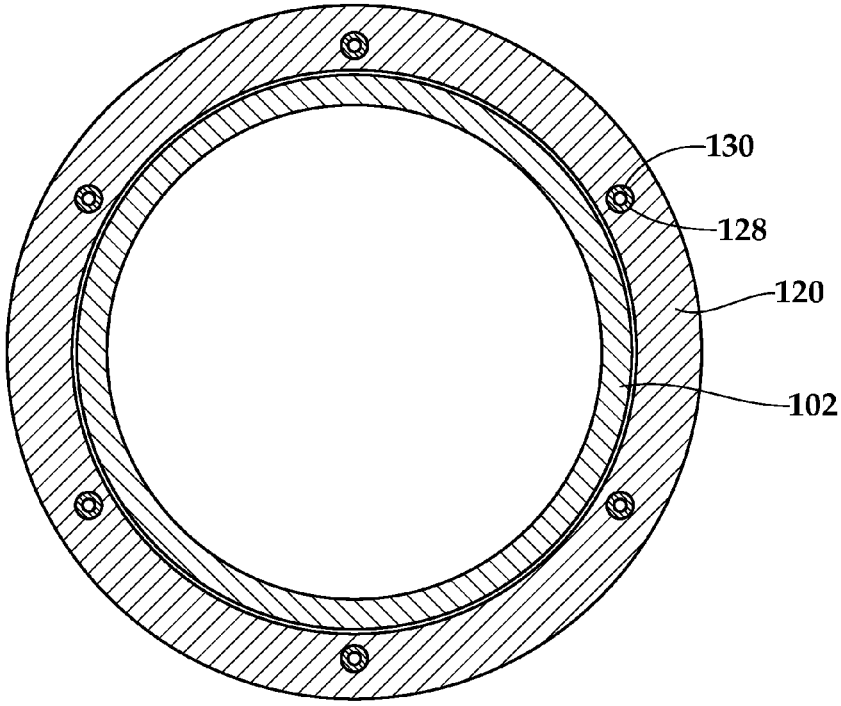
FIG. 2D is a cross sectional view of the flow control screen of FIG. 2B taken along line 2D-2D.

Positioned in the annular region between housing sleeve 118 and base pipe 102 is a split ring spacer 126. Positioned within a plurality of axial openings 128 in flow tube housing 120 are flow tubes 130 that form a fluid flow control section of flow control screen 100. As best seen in FIG. 2D, the illustrated embodiment includes six axial openings 128 and six flow tubes 130, however, those skilled in the art will recognize that other numbers of flow tubes both greater than and less than six could alternatively be used and would be considered within the scope of the present invention. Each of the flow tubes 130 is secured within flow tube housing 120 by a threaded retaining sleeve 132. One or more of the flow tube 130 may have a threaded cap or a plug 134 associated therewith to inhibit or stop flow therethrough. The use of plugs 134 and flow tubes 130 having various inner lengths and diameters allow an operator to adjust the pressure drop rating of each flow control screen 100 to a desired level such that a completion string including a plurality of flow control screens 100 is operable to counteract heel-toe effects in long horizontal completions, balance inflow in highly deviated and fractured wells, reduce annular sand transportation and reduce water/gas influx, thereby lengthening the productive life of the well.

Figure 2E:
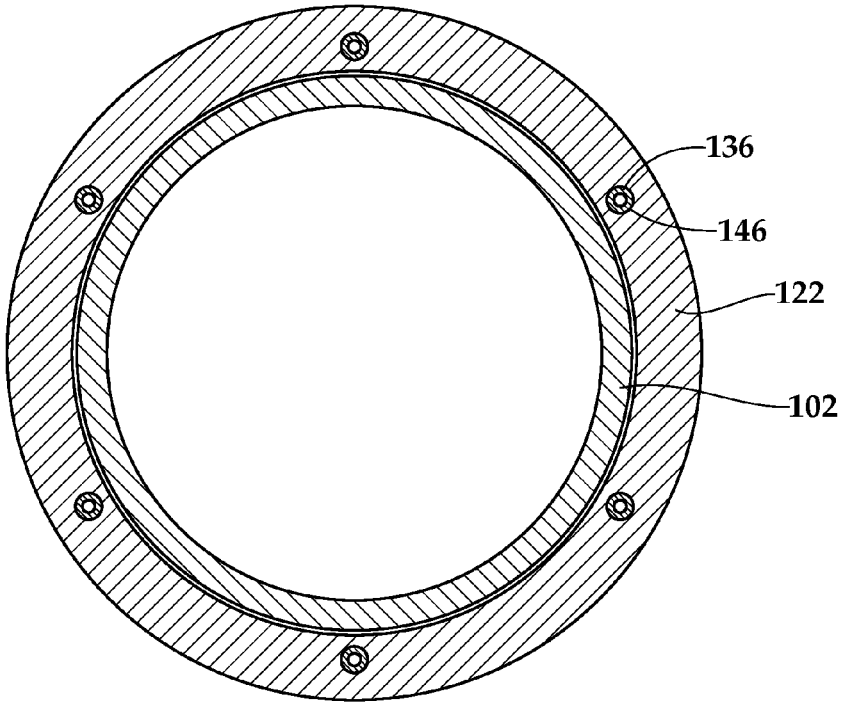
FIG. 2E is a cross sectional view of the flow control screen of FIG. 2C taken along line 2E-2E.
Figure 3A:
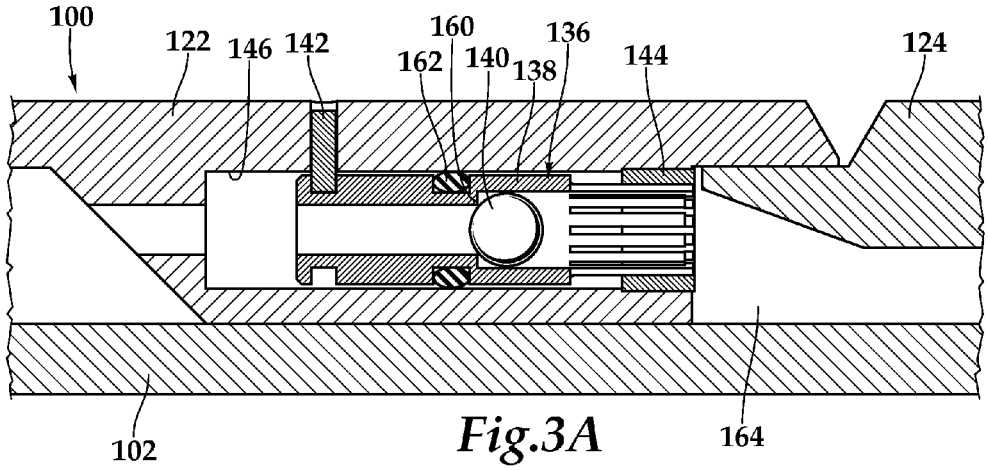
FIGS. 3A-3C are cross sectional views of a valve assembly in its various operating configurations that is operable for use in a flow control screen according to an embodiment of the present invention.
Figure 3B:
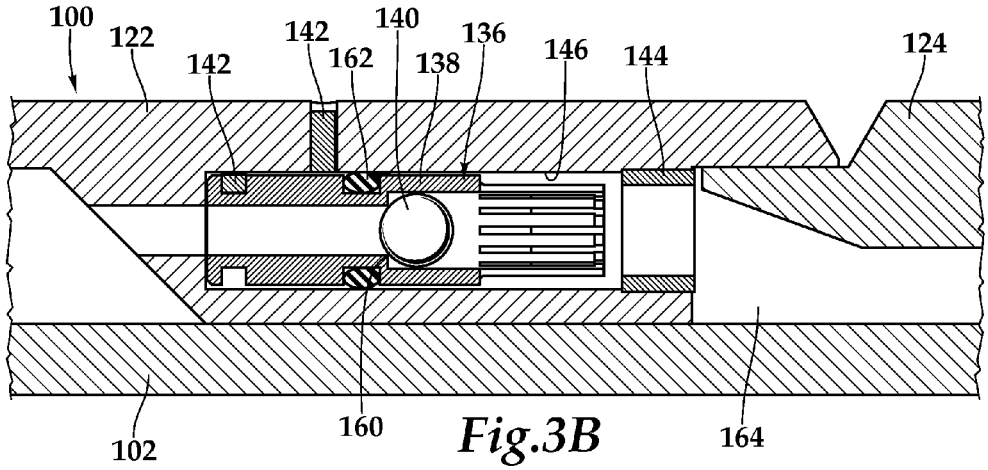
Figure 3C:
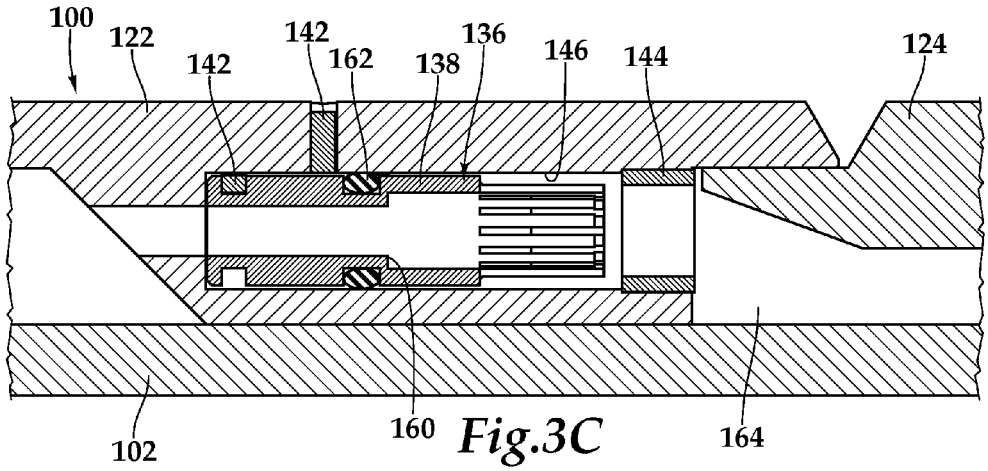
Figure 5:
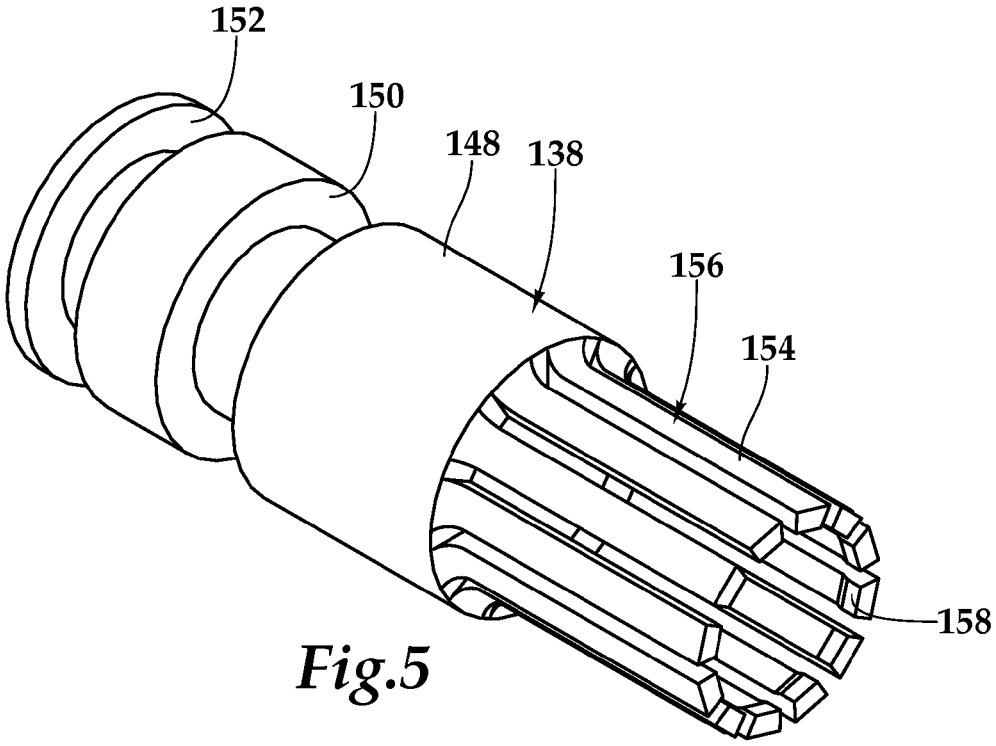
FIG. 5 is an isometric view of a piston assembly positionable in a valve assembly that is operable for use in a flow control screen according to an embodiment of the present invention.

Positioned within a plurality of axial openings 146 in intermediate housing 122 are valve assemblies 136 that form a reverse fluid flow control section of flow control screen 100. As best seen in FIG. 2E, the illustrated embodiment includes six axial openings 146 and six valve assemblies 136, however, those skilled in the art will recognize that other numbers of valve assemblies both greater than and less than six could alternatively be used and would be considered within the scope of the present invention. As best seen in FIGS. 3A-3C, each valve assembly 136 includes a piston assembly 138, a valve plug 140, a retainer pin 142 and a retainer sleeve 144. Piston assembly 138 includes a piston body 148 having an o-ring groove 150 and a pin groove 152, as best seen in FIG. 5. Integrally extending from piston body 148 is a plurality of collet fingers 154 forming a collet assembly 156. Each collet finger 154 includes a radially reduced lip 158. As explained in greater detail below, collet fingers 154 of collet assembly 156 are radially outwardly constrained in a first operating position of piston body 148 to retain valve plug 140 within piston body 148 and radially outwardly unconstrained in a second operating position of piston body 148.

Valve plugs 140 are depicted as spherical blocking members and are initially allowed to move within piston body 148 between shoulder 160 and lips 158, as best seen in FIG. 3A. Those skilled in the art will recognize, however, that even though valve plugs 140 are depicted as spherical in shape, valve plugs 140 could have alternate shapes including cylindrical configurations, substantially cylindrical configurations or other configurations so long as valve plugs 140 are capable of creating a seal within piston body 148 and of being ejected from piston body 148, as described below. As illustrated, uphole travel of each valve plug 140 is limited by shoulder 160 and downhole travel of valve plug 140 is limited by lips 158 as radially outward movement of collet fingers 154 is disallowed by retainer sleeve 144. Axial movement of piston assembly 138 is initially prevented by retainer pin 142, which frangibly secures piston assembly 138 to intermediate housing 122. A seal, depicted as o-ring 162, prevents fluid travel around piston assembly 138 through opening 146.

FIG. 3A represents the running configuration of flow control screen 100 in which valve assemblies 136 are secured to intermediate housing 122 and valve plugs 140 are disposed within piston bodies 148. In this configuration, an internal differential pressure, wherein the pressure inside to base pipe 102 is greater than the pressure outside of base pipe 102, may be applied to the tubular string deploying flow control screens 100. Specifically, the internal differential pressure will travel through production ports 108 but reverse flow through flow control screens 100 is prevented by valve assemblies 136 as valve plugs 140 seat on shoulders 160, as best seen in FIG.

3A. Repeated pressure cycles may be applied to the tubular as long as the pressure remains below the shear pressure of retainer pins 142.

When it is desired to operate flow control screens 100 from the running configuration to the sheared configuration, the internal differential pressure may be raised to a predetermined threshold pressure above the shear pressure of retainer pins 142 causing retainer pins 142 to shear, as best seen in FIG. 3B. In this configuration, valve assemblies 136 continue to hold pressure and prevent reverse fluid flow through flow control screens 100 from production ports 108 to filter medium 112. Once the internal differential pressure is released and an external differential pressure, wherein the pressure outside base pipe 102 is greater than the pressure inside base pipe 102, is applied to flow control screens 100, valve plugs 140 are expelled from piston assemblies 138 as radially outward movement of collet fingers 154 is no longer disallowed by retainer sleeve 144, as best seen in FIG. 3C. Once expelled, valve plugs 140 enter annular region 164 such that valve assemblies 136 no longer prevent reverse fluid flow placing flow control screens 100 in their production configuration.

Figure 4A:
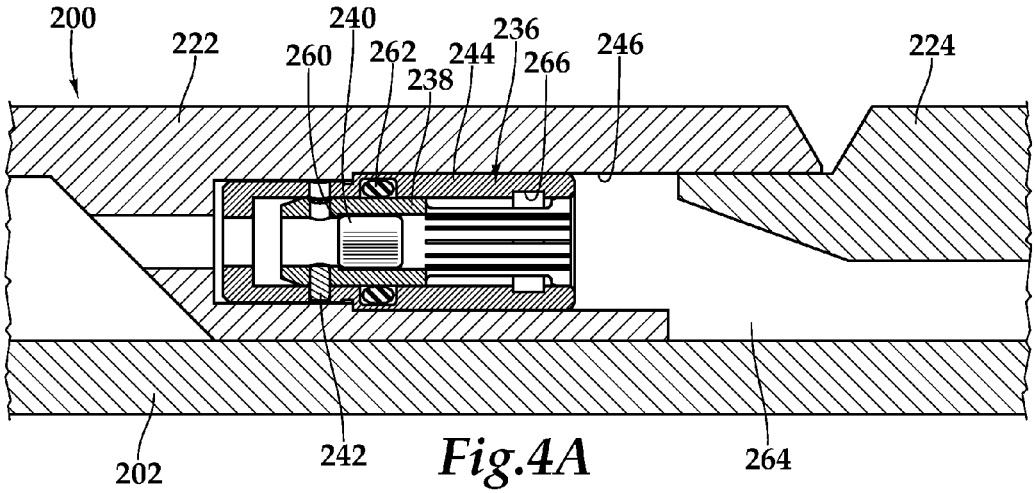
FIGS. 4A-4C are cross sectional views of a valve assembly in its various operating configurations that is operable for use in a flow control screen according to an embodiment of the present invention.
Figure 4B:
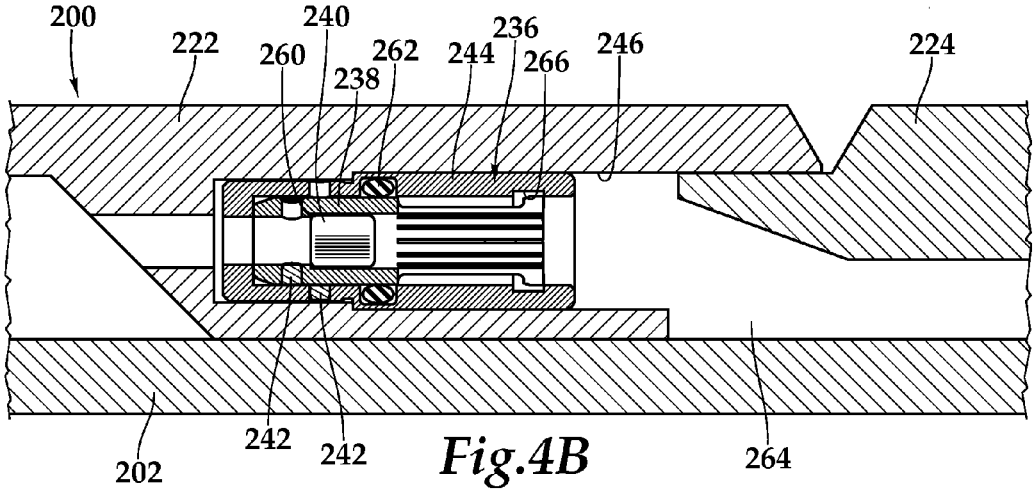
Figure 4C:
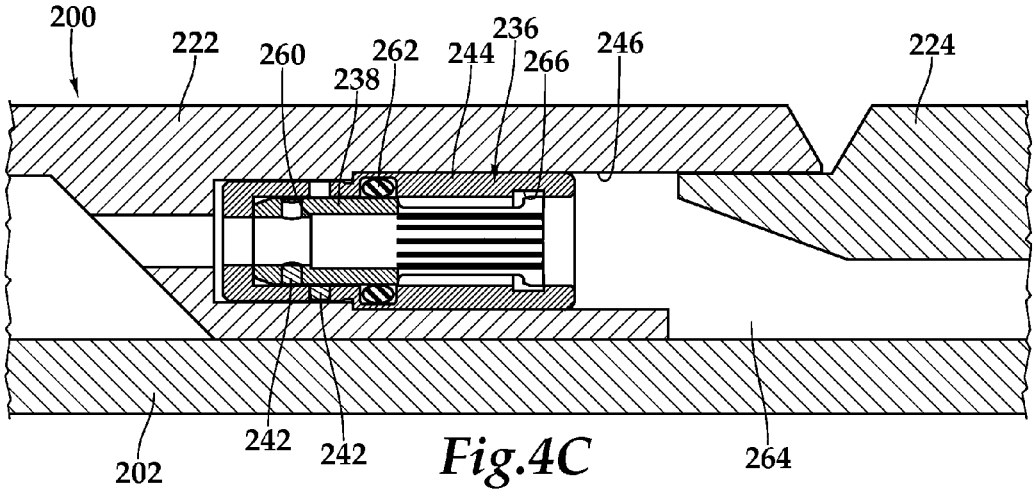
Figure 6:
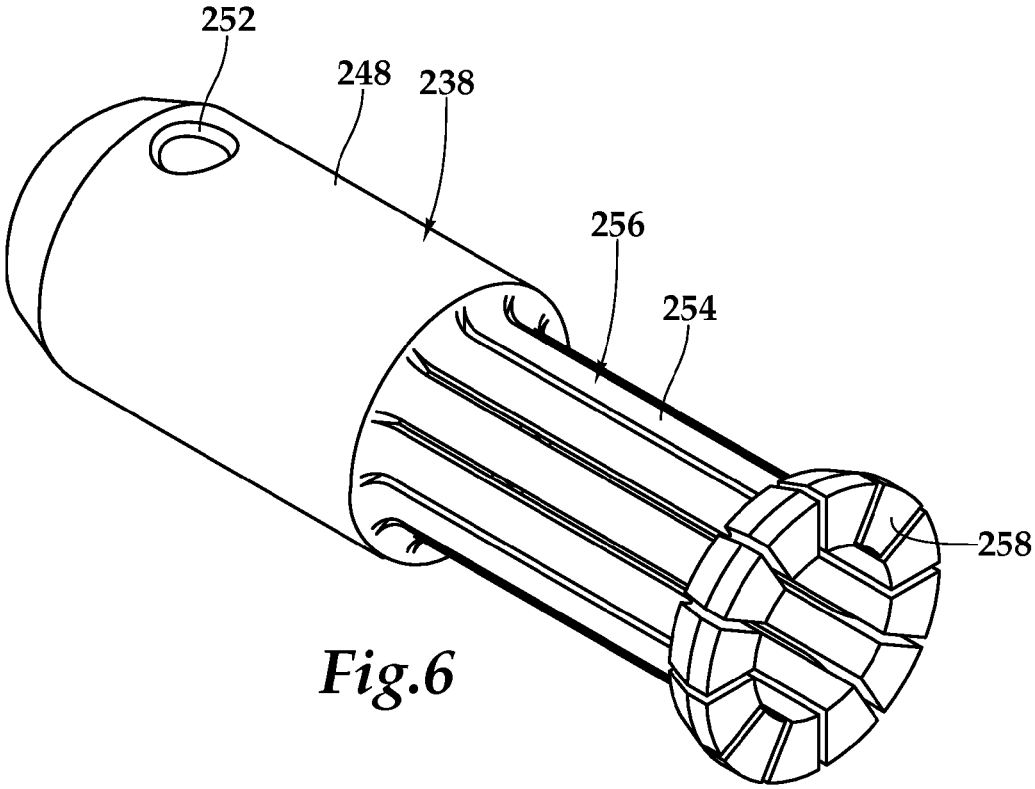
FIG. 6 is an isometric view of a piston assembly positionable in a valve assembly that is operable for use in a flow control screen according to an embodiment of the present invention.

Referring now to FIGS. 4A-4C, therein are depicted an alternate embodiment of a valve assembly positioned within a flow control screen that is generally designated 200. Flow control screen 200 is substantially similar to flow control screen 100 described above with the exceptions as detailed below. In the illustrated portion, flow control screen 200 includes intermediate housing 222 that is securably connected to a production port housing 224 which is preferably welded to base pipe 202 at its downhole end. A plurality of valve assemblies 236, only one being pictured in FIGS. 4A-4C, is positioned within a corresponding number of axial openings 246 of intermediate housing 222. Each valve assembly 236 includes a piston assembly 238, a valve plug 240, a retainer pin 242 and a cylinder assembly 244. Piston assembly 238 includes a piston body 248 having one or more pin openings 252, as best seen in FIG. 6. Integrally extending from piston body 248 is a plurality of collet fingers 254 forming a collet assembly 256. Each collet finger 254 includes a radially expanded lip 258.

Valve plug 240 is depicted as a substantially cylindrical blocking member that is initially allowed to move within piston body 248 between shoulder 260 and a predetermined location within collet assembly 256, as best seen in FIG. 4A. In certain embodiments, it may be preferable to use valve plugs 240 in the form of substantially cylindrical blocking members as the likelihood of this type of valve plug 240 reentering a piston body 248 after being expelled is reduced compared to the spherical blocking member as described above. As illustrated, uphole travel of each valve plug 240 is limited by shoulder 260 and downhole travel of valve plug 240 is limited due to the radially inward compressions of collet fingers 254 caused by the contact between lips 258 and the inner surface of cylinder assembly 244, which disallows radially outward movement of collet fingers 254. Axial movement of piston assembly 238 is initially prevented by retainer pin 242, which frangibly secures piston assembly 238 to cylinder assembly 244. A seal, depicted as o-ring 262, prevents fluid travel around piston assembly 238 through cylinder assembly 244.

FIG. 4A represents the running configuration of flow control screen 200 in which valve assemblies 236 are secured within intermediate housing 222 and valve plugs 240 are disposed within piston bodies 248. In this configuration, internal differential pressure may be applied to the tubular string deploying flow control screen 200. Specifically, the internal differential pressure will travel through production ports but reverse flow through flow control screen 200 is prevented by valve assemblies 236 as valve plugs 240 seat on shoulders 260, as best seen in FIG. 4A. Repeated pressure cycles may be applied to the tubular as long as the pressure remains below the shear pressure of retainer pins 242.

When it is desired to operate flow control screens 200 from the running configuration to the sheared configuration, the internal differential pressure may be raised above the shear pressure of retainer pins 242 causing retainer pins 242 to shear, as best seen in FIG. 4B. In this configuration, valve assemblies 236 continue to hold pressure and prevent reverse fluid flow through flow control screens 200 from the production ports to the filter medium. Once the internal differential pressure is released and an external differential pressure is applied across flow control screen 200, valve plugs 240 are expelled from piston assemblies 238 as radially outward movement of collet fingers 254 is no longer disallowed by cylinder assembly 244 due to the collet groove 266 in cylinder assembly 244, as best seen in FIG. 4C. Once expelled, valve plugs 240 enter annular region 264 such that valve assemblies 236 no longer prevent reverse fluid flow placing flow control screen 200 in its production configuration.

Figure 7A:
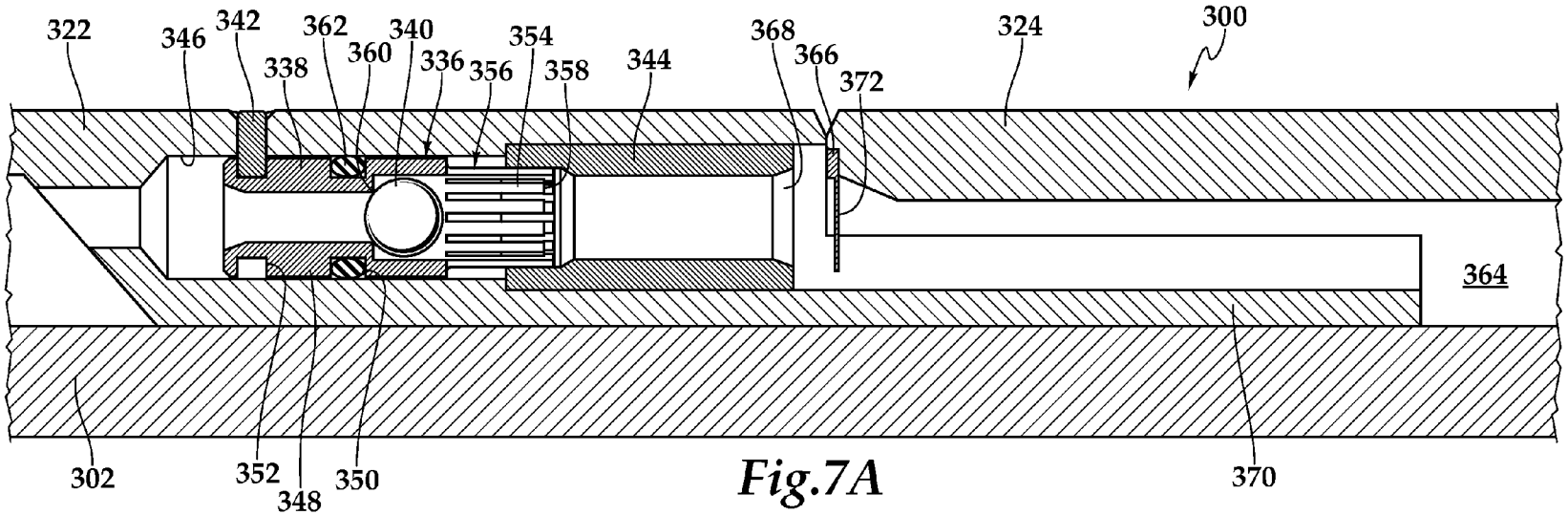
FIG. 7 is cross sectional view of a valve assembly including a reentry barrier that is operable for use in a flow control screen according to an embodiment of the present invention.

Referring now to FIG. 7A, therein is depicted a valve assembly including a reentry barrier that is operable for use in a flow control screen that is generally designated 300. Flow control screen 300 is substantially similar to flow control screen 100 described above with the exceptions as detailed below. In the illustrated portion, flow control screen 300 includes intermediate housing 322 that is securably connected to a production port housing 324 both of which is preferably welded to base pipe 302 at their downhole ends. A plurality of valve assemblies 336, only one being pictured in FIG. 7A, is positioned within a corresponding number of axial openings 346 of intermediate housing 322. Each valve assembly 336 includes a piston assembly 338, a valve plug 340, a retainer pin 342 and a retainer sleeve 344. Piston assembly 338 includes a piston body 348 having an o-ring groove 350 and a pin groove 352. Integrally extending from piston body 348 is a plurality of collet fingers 354 forming a collet assembly 356. Each collet finger 354 includes a radially reduced lip 358. Collet fingers 354 of collet assembly 356 are radially outwardly constrained in a first operating position of piston body 348 to retain valve plug 340 within piston body 348 and radially outwardly unconstrained in a second operating position of piston body 348.

Figure 7B:
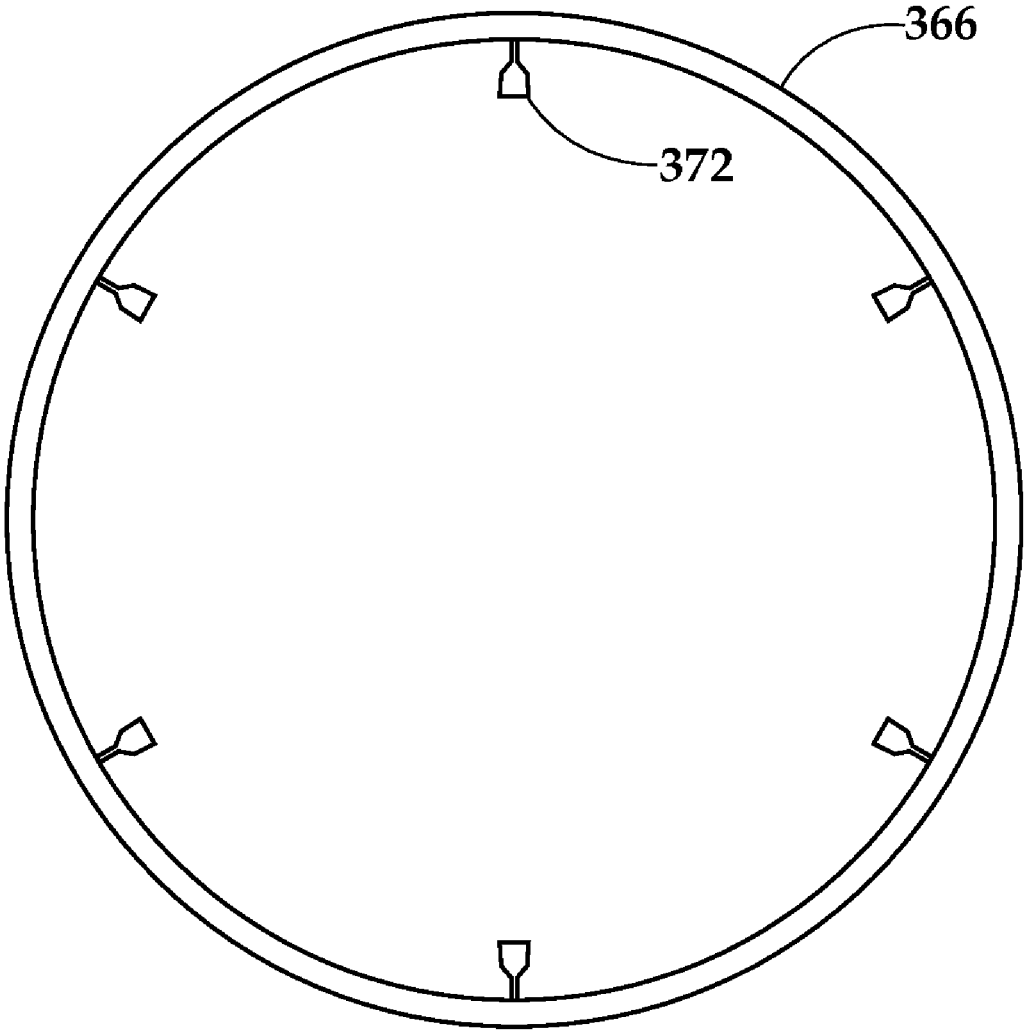

Valve plugs 340 are depicted as spherical blocking members. Initially, uphole travel of each valve plug 340 is limited by shoulder 360 and downhole travel of valve plug 340 is limited by lips 358 as radially outward movement of collet fingers 354 is disallowed by retainer sleeve 344. Axial movement of piston assembly 338 is initially prevented by retainer pin 342, which frangibly secures piston assembly 338 to intermediate housing 322. A seal, depicted as o-ring 362, prevents fluid travel around piston assembly 338 through opening 346. In the illustrated embodiment, a reentry barrier 366 is secured between intermediate housing 322 and production port housing 324. Reentry barrier 366 is positioned proximate the discharge ends 368 of retainer sleeves 344 and is axially disposed within intermediate housing extensions 370. As best seen in FIG. 7B, reentry barrier 366 is depicted as including a plurality of flexible arms 372 that allows valve plugs 340 to exit valve assemblies 336 but prevents reentry of valve plugs 340 into valve assemblies 336. Preferably, the number of flexible arms 372 corresponds with the number of valve assemblies 336.

FIG. 7A represents the running configuration of flow control screen 300 in which valve assemblies 336 are secured within intermediate housing 322 and valve plugs 340 are disposed within piston bodies 348. In this configuration, internal differential pressure may be applied to the tubular string deploying flow control screen 300. Specifically, the internal differential pressure will travel through production ports but reverse flow through flow control screen 300 is prevented by valve assemblies 336 as valve plugs 340 seat on shoulders 360. Repeated pressure cycles may be applied to the tubular as long as the pressure remains below the shear pressure of retainer pins 342.

When it is desired to operate flow control screens 300 from the running configuration to the sheared configuration, the internal differential pressure may be raised above the shear pressure of retainer pins 342 causing retainer pins 342 to shear. In this configuration, valve assemblies 336 continue to hold pressure and prevent reverse fluid flow through flow control screens 300 from the production ports to the filter medium. Once the internal differential pressure is released and an external differential pressure is applied across flow control screen 300, valve plugs 340 are expelled from piston assemblies 338 as radially outward movement of collet fingers 354 is no longer disallowed by retainer sleeve 344. Valve plugs 340 then pass through retainer sleeve 344, pass by flexible arms 372 and enter annular region 364. Once discharged, reentry of a valve plug 340 into a piston assembly 338 is disallowed by arms 372 of reentry barrier 366 such that valve assemblies 336 no longer prevent reverse fluid flow placing flow control screen 300 in its production configuration.

Figure 8:
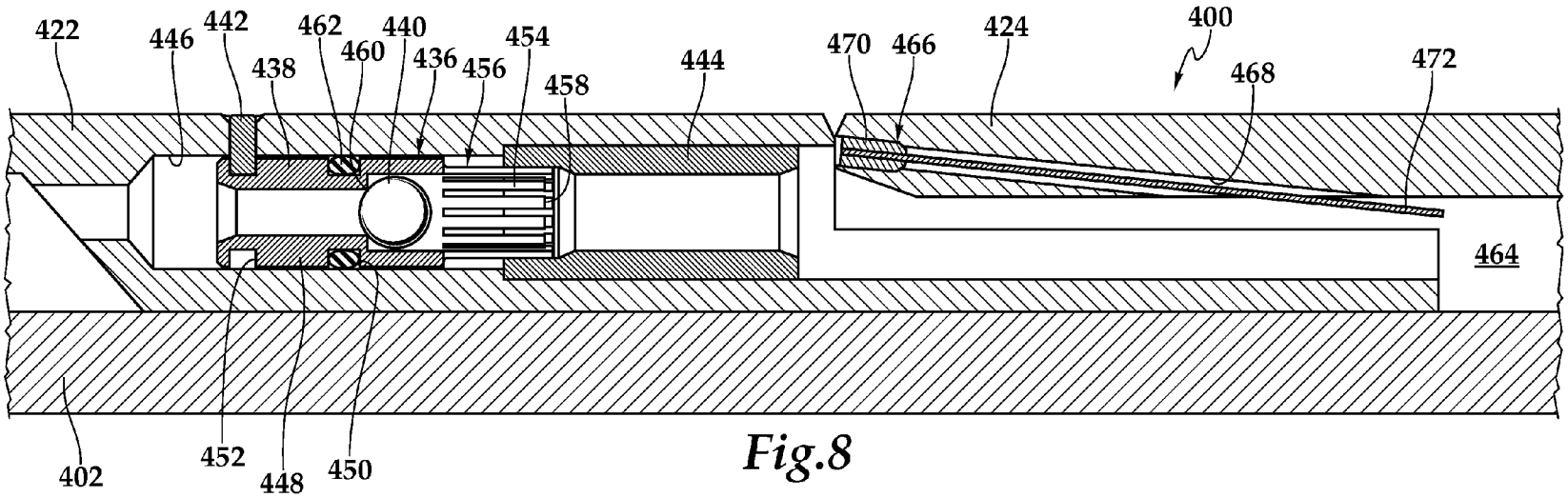
FIG. 8 is cross sectional view of a valve assembly including a reentry barrier that is operable for use in a flow control screen according to another embodiment of the present invention.

Referring now to FIG. 8, therein is depicted a valve assembly including a reentry barrier that is operable for use in a flow control screen that is generally designated 400. Flow control screen 400 is substantially similar to flow control screen 100 described above with the exceptions as detailed below. In the illustrated portion, flow control screen 400 includes intermediate housing 422 that is securably connected to a production port housing 424 both of which is preferably welded to base pipe 402 at their downhole ends. A plurality of valve assemblies 436, only one being pictured in FIG. 8, is positioned within a corresponding number of axial openings 446 of intermediate housing 422. Each valve assembly 436 includes a piston assembly 438, a valve plug 440, a retainer pin 442 and a retainer sleeve 444. Piston assembly 438 includes a piston body 448 having an o-ring groove 450 and a pin groove 452. Integrally extending from piston body 448 is a plurality of collet fingers 454 forming a collet assembly 456. Each collet finger 454 includes a radially reduced lip 458. Collet fingers 454 of collet assembly 456 are radially outwardly constrained in a first operating position of piston body 448 to retain valve plug 440 within piston body 448 and radially outwardly unconstrained in a second operating position of piston body 448.

Valve plugs 440 are depicted as spherical blocking members. Initially, uphole travel of each valve plug 440 is limited by shoulder 460 and downhole travel of valve plug 440 is limited by lips 458 as radially outward movement of collet fingers 454 is disallowed by retainer sleeve 444. Axial movement of piston assembly 438 is initially prevented by retainer pin 442, which frangibly secures piston assembly 438 to intermediate housing 422. A seal, depicted as o-ring 462, prevents fluid travel around piston assembly 438 through opening 446. In the illustrated embodiment, a plurality of reentry barriers 466, only one being pictured in FIG. 8, is positioned within a corresponding number of angled openings 468 of production port housing 424. Each reentry barrier 466 includes a support member 470 that is preferably welded within opening 468 and a rod member 472 that preferably extends into annular region 464. In this configuration, rod members 472 allow valve plugs 440 to exit valve assemblies 436 but prevent reentry of valve plugs 440 into valve assemblies 436.

FIG. 8 represents the running configuration of flow control screen 400 in which valve assemblies 436 are secured within intermediate housing 422 and valve plugs 440 are disposed within piston bodies 448. In this configuration, internal differential pressure may be applied to the tubular string deploying flow control screen 400. Specifically, the internal differential pressure will travel through production ports but reverse flow through flow control screen 400 is prevented by valve assemblies 436 as valve plugs 440 seat on shoulders 460. Repeated pressure cycles may be applied to the tubular as long as the pressure remains below the shear pressure of retainer pins 442.

When it is desired to operate flow control screens 400 from the running configuration to the sheared configuration, the internal differential pressure may be raised above the shear pressure of retainer pins 442 causing retainer pins 442 to shear. In this configuration, valve assemblies 436 continue to hold pressure and prevent reverse fluid flow through flow control screens 400 from the production ports to the filter medium. Once the internal differential pressure is released and an external differential pressure is applied across flow control screen 400, valve plugs 440 are expelled from piston assemblies 438 as radially outward movement of collet fingers 454 is no longer disallowed by retainer sleeve 444. Valve plugs 440 then pass through retainer sleeve 444, pass by rod members 472 and enter annular region 464. Once discharged, reentry of a valve plug 440 into a piston assembly 438 is disallowed by rod members 472 such that valve assemblies 436 no longer prevent reverse fluid flow placing flow control screen 400 in its production configuration.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A flow control screen having a fluid flow path between a perforated section of a base pipe and a filter medium positioned around a blank pipe section of the base pipe, the flow control screen comprising:

at least one valve assembly disposed within the fluid flow path, the at least one valve assembly including a piston body and a valve plug, the piston body having an internal seat and a collet assembly that is radially outwardly constrained in a first operating position of the piston body to retain the valve plug therein and radially outwardly unconstrained in a second operating position of the piston body, wherein an internal differential pressure seats the valve plug on the internal seat to prevent reverse flow;

wherein a predetermined internal differential pressure on the valve plug causes the piston body to shift from the first operating position to the second operating position while continuing to prevent reverse flow; and wherein an external differential pressure causes the valve plug to be expelled through the collet assembly when the piston body is in the second operating position, thereby no longer preventing reverse flow.

2. The flow control screen as recited in claim 1 wherein the at least one valve assembly further comprises a retainer sleeve that radially outwardly constrains the collet assembly in the first operating position of the piston body.

3. The flow control screen as recited in claim 2 wherein the piston assembly is slidably positioned within an axial opening of a housing member of the flow control screen.

4. The flow control screen as recited in claim 3 wherein the piston assembly and the housing member are initially secured together with a retainer pin that prevents movement of the piston body from the first operating position to the second operating position until the predetermined internal differential pressure acts on the valve plug.

5. The flow control screen as recited in claim 1 wherein the at least one valve assembly further comprises a cylinder assembly that radially outwardly constrains the collet assembly in the first operating position of the piston body but does not radially outwardly constrain the collet assembly in the second operating position of the piston body.

6. The flow control screen as recited in claim 5 wherein the piston assembly is slidably positioned within the cylinder assembly.

7. The flow control screen as recited in claim 6 wherein the piston assembly and the cylinder assembly are initially secured together with a retainer pin that prevents movement of the piston body from the first operating position to the second operating position until the predetermined internal differential pressure acts on the valve plug.

8. The flow control screen as recited in claim 1 wherein the valve plug is selected from the group consisting of a spherical blocking member and a substantially cylindrical blocking member.

9. The flow control screen as recited in claim 1 wherein the collet assembly further comprises a plurality of collet fingers having radially inwardly projecting lips.

10. The flow control screen as recited in claim 1 wherein the collet assembly further comprises a plurality of collet fingers having radially outwardly projecting lips.

11. The flow control screen as recited in claim 1 further comprising a fluid flow control section in the fluid flow path that causes a pressure drop in fluids traveling therethrough.

12. The flow control screen as recited in claim 1 further comprising at least one reentry barrier in the fluid flow path operable to prevent reentry of the valve plug into the piston body.

13. A flow control screen having a fluid flow path between a perforated section of a base pipe and a filter medium positioned around a blank pipe section of the base pipe, the flow control screen comprising:

a plurality of circumferentially distributed valve assemblies disposed within the fluid flow path, each valve assembly including a piston body and a valve plug, each piston body having an internal seat and a collet assembly that is radially outwardly constrained in a first operating position of the piston body to retain the valve plug therein and radially outwardly unconstrained in a second operating position of the piston body, wherein internal differential pressure seats the valve plugs on the internal seats to prevent reverse flow;

wherein a predetermined internal differential pressure on the valve plugs causes the piston bodies to shift from the first operating position to the second operating position while continuing to prevent reverse flow; and wherein external differential pressure causes the valve plugs to be expelled through the collet assemblies when the piston bodies are in the second operating position, thereby no longer preventing reverse flow.

14. The flow control screen as recited in claim 13 wherein each valve assembly further comprises a retainer sleeve that radially outwardly constrains the collet assembly in the first operating position of the piston body.

15. The flow control screen as recited in claim 13 wherein each valve assembly further comprises a cylinder assembly that radially outwardly constrains the collet assembly in the first operating position of the piston body but does not radially outwardly constrain the collet assembly in the second operating position of the piston body.

16. The flow control screen as recited in claim 13 wherein the valve plugs are selected from the group consisting of spherical blocking members and substantially cylindrical blocking members.

17. The flow control screen as recited in claim 13 further comprising a fluid flow control section in the fluid flow path that causes a pressure drop in fluids traveling therethrough.

18. The flow control screen as recited in claim 13 further comprising at least one reentry barrier in the fluid flow path operable to prevent reentry of the valve plugs into the piston bodies.

19. A method for operating a flow control screen comprising:

disposing at least one valve assembly within a fluid flow path between a perforated section of a base pipe and a filter medium positioned around a blank pipe section of the base pipe;

retaining a valve plug within a piston body of the valve assembly by radially outwardly constraining a collet assembly in a first operating position of the piston body;

applying an internal differential pressure to seat the valve plug on an internal seat of the piston body to prevent reverse flow;

applying a predetermined internal differential pressure on the valve plugs to shift the piston body from the first operating position to a second operating position while continuing to prevent reverse flow; and applying an external differential pressure to expel the valve plug through the collet assembly, thereby no longer preventing reverse flow.

20. The method as recited in claim 19 further comprising preventing reentry of the valve plug into the piston body with at least one reentry barrier disposing within the fluid flow path between the perforated section of a base pipe and the at least one valve assembly.

* * * * *